US007905670B2

(12) United States Patent
Arrington et al.

(10) Patent No.: US 7,905,670 B2
(45) Date of Patent: Mar. 15, 2011

(54) METHOD AND APPARATUS FOR EXPOSING PRINTABLE MEDIA IN A PRINTER

(75) Inventors: Stacy Leigh Arrington, Raleigh, NC (US); Richard Hunter Harris, Raleigh, NC (US); Robert Andrew Myers, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 613 days.

(21) Appl. No.: 11/926,774

(22) Filed: Oct. 29, 2007

(65) Prior Publication Data

US 2009/0110463 A1 Apr. 30, 2009

(51) Int. Cl.

| | |
|---|---|
| ***B41J 29/13*** | (2006.01) |
| ***B41J 29/00*** | (2006.01) |
| ***B41J 15/04*** | (2006.01) |
| ***B65H 16/02*** | (2006.01) |
| *B65H 16/08* | (2006.01) |

(52) U.S. Cl. ..... 400/613; 400/693; 400/680

(58) Field of Classification Search ..... 400/613, 400/693, 680

See application file for complete search history.

(56) References Cited

U.S. PATENT DOCUMENTS

| | | | | |
|---|---|---|---|---|
| 3,180,572 | A | 4/1965 | Gallant | |
| 3,216,021 | A * | 11/1965 | Stefansson | 346/136 |
| 4,119,385 | A | 10/1978 | Watanabe et al. | |
| 4,961,659 | A | 10/1990 | Igarashi | |
| 5,137,385 | A | 8/1992 | Kamimura et al. | |
| 5,302,037 | A * | 4/1994 | Schoendienst et al. | 400/586 |
| 6,155,730 | A | 12/2000 | Nakayama et al. | |
| 6,443,645 | B1 | 9/2002 | Takei et al. | |
| 6,698,959 | B2 * | 3/2004 | Kaya | 400/613 |
| 6,789,969 | B2 | 9/2004 | Hirabayashi et al. | |
| 6,921,141 | B1 * | 7/2005 | Porco | 312/100 |
| 7,237,743 | B2 * | 7/2007 | Czechowicz et al. | 242/527 |
| 2006/0165467 | A1 * | 7/2006 | Kawakami et al. | 400/613 |

FOREIGN PATENT DOCUMENTS

| | | | |
|---|---|---|---|
| DE | 10041259 | A1 * | 3/2002 |
| JP | 11084982 | A * | 3/1999 |
| JP | 11106096 | A * | 4/1999 |
| JP | 11129576 | A * | 5/1999 |

OTHER PUBLICATIONS

Harris et al., "Cover Positioning and Up-Stop Device", IBM Technical Disclosure Bulletin, vol. 40, No. 4, Apr. 1997, pp. 11-13.

* cited by examiner

*Primary Examiner* — Daniel J Colilla
(74) *Attorney, Agent, or Firm* — Yee & Associates, P.C.; Tom E. Tyson

(57) ABSTRACT

The illustrative embodiments described herein provide an apparatus and method for exposing printable media. The apparatus includes a printer having a cover. The apparatus also includes a set of lifting arms coupled to the cover. The apparatus includes a slowing device engaged with the set of lifting arms. The slowing device is adapted to slow movement of the set of lifting arms when the cover is moved. The apparatus also includes a stage coupled to the set of lifting arms such that movement of the cover causes movement of the stage into a position. The stage is adapted to receive the printable media. The position facilitates exposure of the printable media.

20 Claims, 7 Drawing Sheets

METHOD AND APPARATUS FOR EXPOSING PRINTABLE MEDIA IN A PRINTER

BACKGROUND OF THE INVENTION

1. Field of the Invention

The present invention relates generally to a method and apparatus for exposing printable media. More particularly, the present invention relates to a method and apparatus for exposing printable media in a printer.

2. Description of the Related Art

Many types of printers, such as point-of-sale printers, contain printable media that may be printed on to form a printed document. Printable media is any material that is capable of being printed on by a printer, such as a roll of paper, a roll of heat-sensitive paper, one or more pre-cut paper sheets, a roll of flat, transparent plastic, carbon paper, or photographic paper. As the printable media in a printer becomes depleted, additional printable media must be added to the printer so that operation of the printer may continue.

For example, some printers, including some point of sale printers, use printable media that is in the form of one or more rolls of paper. These rolls of paper may be formed on small plastic or cardboard cores that help maintain the cylindrical shape of the roll. As paper on the roll of paper is used for printing, the roll of paper becomes smaller. However, the smaller roll of paper may not be easily visible to the human eye when, for example, the cover of the printer is lifted. The inability of a user to determine that the roll of paper is nearing exhaustion adversely affects the user's ability to add additional paper to the printer when necessary.

Furthermore, the printer cavity into which the roll of paper is held may be deep, dark, or obscured by other printer components, thereby further adversely affecting the user's ability to detect depletion of the roll of paper. Such printers may also adversely affect the user's ability to quickly and easily access the depleted roll of paper. As a result, the process of removing an exhausted roll of paper and adding additional paper is more time-consuming, requires more labor, and can lead to unnecessary complications.

If the core is all that remains in the printer, the user may have an even harder time detecting depleted roll of paper. In this situation, if the user adds an additional roll of paper into the printer without detecting and removing the core, the printer will not operate properly and may also be damaged.

Other types of printers utilize a spindle or other bearing device that engages the hollow center of the cylindrical core. However, the use of such a spindle further complicates the process of additional printable media by requiring the disengagement of the spindle from the hollow center of the core. Disengaging the spindle may require the manipulation of disassembly of adjacent parts so that the core may be removed from the printer.

BRIEF SUMMARY OF THE INVENTION

The illustrative embodiments described herein provide an apparatus and method for exposing printable media. The apparatus includes a printer having a cover. The cover is moveable to a plurality of positions. The apparatus also includes a set of lifting arms coupled to the cover. The apparatus includes a slowing device engaged with the set of lifting arms. The slowing device is adapted to slow movement of the set of lifting arms when the cover is moved from one position to another position in the plurality of positions. The apparatus also includes a stage coupled to the set of lifting arms such that movement of the cover causes movement of the stage into a position. The stage is adapted to receive the printable media. The position facilitates exposure of the printable media.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
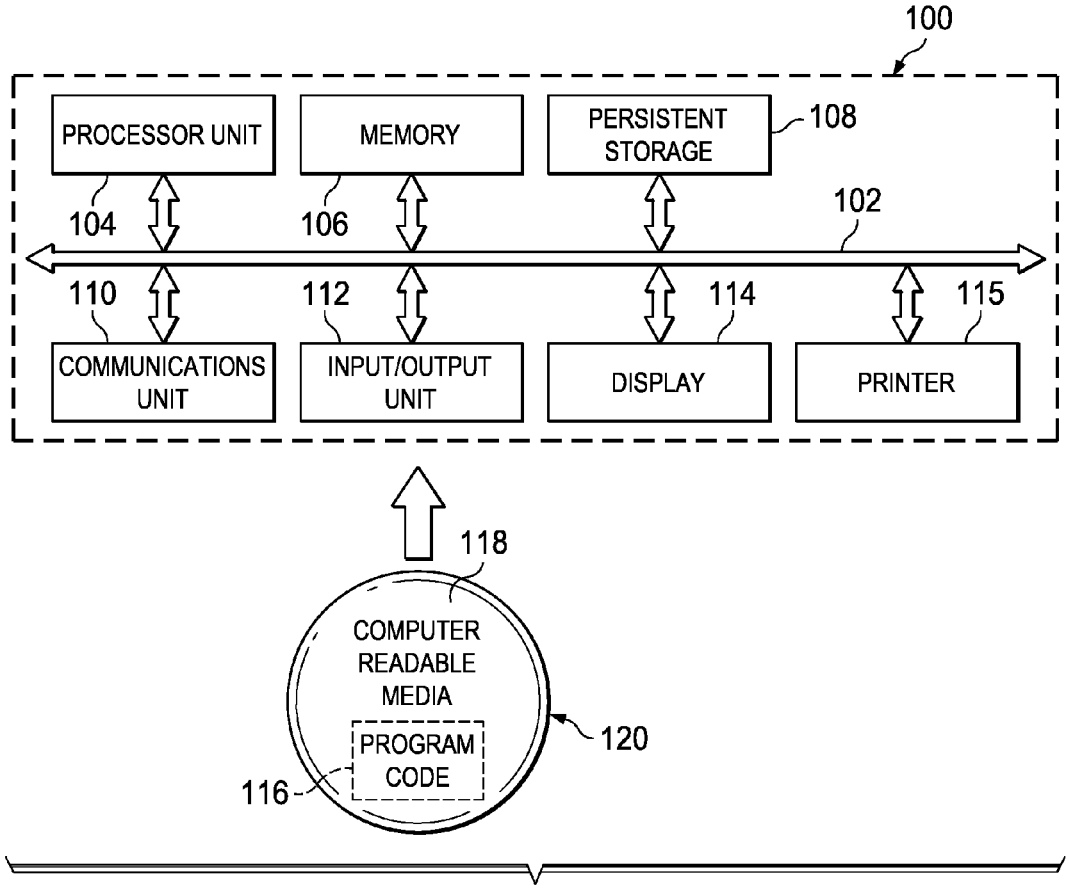
FIG. 1 is a block diagram of a data processing system in accordance with an illustrative embodiment of the present invention.

Turning now to FIG. 1, a block diagram of a data processing system is depicted in accordance with an illustrative embodiment of the present invention. In this illustrative example, data processing system 100 includes communications fabric 102, which provides communications between processor unit 104, memory 106, persistent storage 108, communications unit 110, input/output (I/O) unit 112, display 114, and printer 115.

Processor unit 104 serves to execute instructions for software that may be loaded into memory 106. Processor unit 104 may be a set of one or more processors or may be a multiprocessor core, depending on the particular implementation. Further, processor unit 104 may be implemented using one or more heterogeneous processor systems in which a main processor is present with secondary processors on a single chip. As another illustrative example, processor unit 104 may be a symmetric multi-processor system containing multiple processors of the same type.

Memory 106, in these examples, may be, for example, a random access memory. Persistent storage 108 may take various forms depending on the particular implementation. For example, persistent storage 108 may contain one or more components or devices. For example, persistent storage 108 may be a hard drive, a flash memory, a rewritable optical disk, a rewritable magnetic tape, or some combination of the above. The media used by persistent storage 108 also may be removable. For example, a removable hard drive may be used for persistent storage 108.

Communications unit 110, in these examples, provides for communications with other data processing systems or devices. In these examples, communications unit 110 is a network interface card. Communications unit 110 may provide communications through the use of either or both physical and wireless communications links.

Input/output unit 112 allows for input and output of data with other devices that may be connected to data processing system 100. For example, input/output unit 112 may provide a connection for user input through a keyboard and mouse. Further, input/output unit 112 may send output to printer 115. Display 114 provides a mechanism to display information to a user.

Instructions for the operating system and applications or programs are located on persistent storage 108. These instructions may be loaded into memory 106 for execution by processor unit 104. The processes of the different embodiments may be performed by processor unit 104 using computer implemented instructions, which may be located in a memory, such as memory 106. These instructions are referred to as, program code, computer usable program code, or computer readable program code that may be read and executed by a processor in processor unit 104. The program code in the different embodiments may be embodied on different physical or tangible computer readable media, such as memory 106 or persistent storage 108. In one embodiment, the program code may be executed to perform processes, such as printing a receipt on printer 115 for transactions that occurs at a point of sale.

Printer 115 may be used to print any type of document. Instructions may be sent to printer 115 on communications fabric 102 to provide printer 115 with a set of parameters relating to the printing of one or more documents. These parameters may contain, for example, data that should be printed on a receipt to be printed by printer 115 at a point of sale. In addition, because printer 115 is compatible with a variety of different operating systems, such as Microsoft® Windows or Unix, instructions may be sent to printer 115 regardless of the operating system executing on data processing system 100. Microsoft and Windows are trademarks of Microsoft Corporation in the United States, other countries, or both. Printer 115 may be connected to one or more of the other components of the FIG. 1 via a direction connection, such as a bus, or over a network, such as the Internet.

Program code 116 is located in a functional form on computer readable media 118 and may be loaded onto or transferred to data processing system 100 for execution by processor unit 104. Program code 116 and computer readable media 118 form computer program product 120 in these examples. In one example, computer readable media 118 may be in a tangible form, such as, for example, an optical or magnetic disc that is inserted or placed into a drive or other device that is part of persistent storage 108 for transfer onto a storage device, such as a hard drive that is part of persistent storage 108. In a tangible form, computer readable media 118 also may take the form of a persistent storage, such as a hard drive or a flash memory that is connected to data processing system 100. The tangible form of computer readable media 118 is also referred to as computer recordable storage media.

Alternatively, program code 116 may be transferred to data processing system 100 from computer readable media 118 through a communications link to communications unit 110 and/or through a connection to input/output unit 112. The communications link and/or the connection may be physical or wireless in the illustrative examples. The computer readable media also may take the form of non-tangible media, such as communications links or wireless transmissions containing the program code.

The different components illustrated for data processing system 100 are not meant to provide architectural limitations to the manner in which different embodiments may be implemented. The different illustrative embodiments may be implemented in a data processing system including components in addition to or in place of those illustrated for data processing system 100. Other components shown in FIG. 1 can be varied from the illustrative examples shown.

For example, a bus system may be used to implement communications fabric 102 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 106 or a cache such as found in an interface and memory controller hub that may be present in communications fabric 102.

Figure 2:
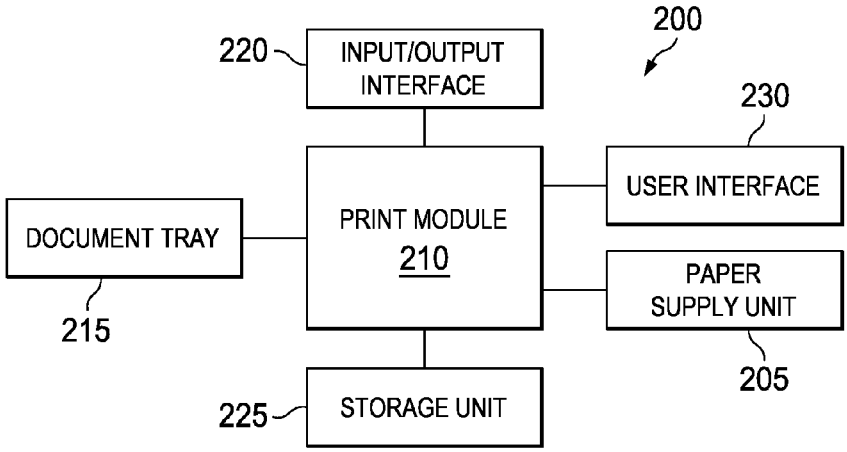
FIG. 2 is a block diagram of a printer in which the illustrative embodiments may be implemented.

Turning now to FIG. 2, a block diagram of a printer is depicted in which the illustrative embodiments may be implemented. Printer 200 is a non-limiting example of printer 115 in FIG. 1. In this illustrative example, printer 200 may be any type of printer, such as, for example, a thermal printer, toner-based printer, liquid inkjet printer, solid ink printer, dye-sublimation printer, inkless printer, impact printer, daisy wheel printer, dot-matrix printer, line printer, or a pen-based plotter. Printer 200 may be used in any type of application, such as a point of sale printer, an office printer, or a home-use printer. A point of sale printer is sometimes referred to as a fiscal printer.

Printer 200 includes paper supply unit 205. Paper supply unit 205 holds printable media that is used by printer 200 to print documents. The printable media in paper supply unit 205 may take a variety of forms, such as a roll of printable media or a stack of pre-cut sheets of printable media. The printable media may be made of any material that is capable of being printed on by printer 200, such as paper or heat-sensitive material.

Printer 200 includes print module 210. Print module 210 is the hardware in printer 200 that prints on the printer media to create a document. For example, print module 210 may apply ink to a paper in paper supply unit 205 using a toner. In another example, print module 210 uses thermal-printing techniques by selectively heating regions of portions of a roll of heat-sensitive paper in paper supply unit 205. In another example, print module 210 applies ink to one or more sheets of pre-cut paper in paper supply unit 205.

Documents created in print module 210 exit printer 200 at document tray 215. The documents at document tray 215 may be retrieved by a user or by another device for processing.

Printer 200 includes input/output interface 220. Input/output interface 220 is an interface between printer 200 and any external devices. Input/output interface 220 may be, for example, one or more ports into which a detachable storage device may be received. Input/output interface 220 may also be a connection port into which a computer, point of sale device, cash register, or any other data processing system is connected. For example, printer 200 may be connected to one or more of the components of printer 200 via input/output interface 220.

Data received at input/output interface 220 may be sent to other components of printer 200 and used in the creation of documents. For example, transaction information may be sent to printer 200 at input/output interface 220 from a point of sale device so that a receipt may be printed using a roll of heat-sensitive paper in paper supply unit 205. This data may be buffered or otherwise stored in storage unit 225. Storage unit 225 may be random access memory, a hard drive, or detachment forms of memory.

Printer 200 also includes user interface 230. User interface 230 includes any controls that allow a user to adjust settings for printer 200. For example, user interface 230 may include controls that allow a user to select a type of paper in paper supply unit 205 to be used to create a document. User interface 230 may also include a control, such as a button or knob, which opens the cover of printer 200. The cover may enclose the paper in paper supply unit 205. Alternatively, user interface 230 may be displayed on a graphical user interface of data processing system that is connected to printer 200 via input/output interface 220.

Figure 3:
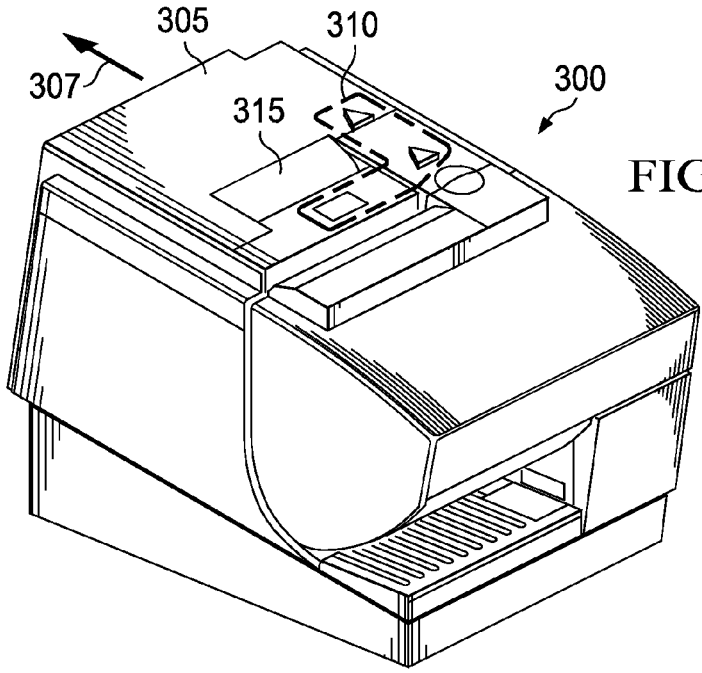
FIG. 3 is an illustration of a printer used to expose printable media in accordance with an illustrative embodiment.

Turning now to FIG. 3, an illustration of a printer used to expose printable media is depicted in accordance with an illustrative embodiment. Specifically, FIG. 3 illustrates printer 300, which is a non-limiting example of printer 115 in FIG. 1 and printer 200 in FIG. 2.

As used herein, the term "expose" means to facilitate a user's visual perception of the printable media, and also to facilitate a user's physical access to the printable media. For example, by exposing the printable media, the illustrative embodiments facilitate a user's ability to grasp and remove the printable media.

In one non-limiting example, printer 300 is a point of sale printer. Printer 300 includes cover 305. Cover 305 is coupled to printer 300 and covers an area of printer 300 that holds printable media, such as a roll of paper.

Cover 305 may be coupled to printer 300 in a variety of ways. For example, cover 305 may rest on printer 300 without the aid of any connections at all. In another example, one side of cover 305 may be pivotably coupled to printer 300 such that any particular side of cover 305 may be lifted, thereby revealing the contents of printer 300 concealed by cover 305. The pivotable coupling between cover 305 and printer 300 may include one or more hinges, screws, or bolts. Additional details about pivotable couplings between cover 305 and printer 300 will be given with respect to FIG. 5 below. Cover 305 may also be slidably coupled to printer 300 such that cover 305 may slide off printer 300 in the direction indicated by arrow 307.

Cover 305 may be removed or opened in a variety of ways. For example, a user may manually move cover 305 into an open position. In another example, a user may open cover 305 using user interface controls 310. In this example, one of the buttons in user interface controls 310 may function to open cover 305. Cover 305 may also be opened by issuing instruction to printer 300 using a data processing system, such as data processing system 100 in FIG. 1.

Printer 300 also includes document tray 315. Document tray 315 is a non-limiting example of document tray 215 in FIG. 2. For example, transaction documents, such as receipts, that are printed using printer 300 may exit printer 300 and come to rest at document tray 315. A user may then retrieve these receipts at document tray 315.

The illustrative embodiments described herein provide an apparatus and method for exposing printable media. In one embodiment, the printable media is a roll of paper. The apparatus includes a printer having a cover. The cover is moveable to a plurality of positions. The plurality of positions includes an open position, a closed position, and all intermediate positions.

The apparatus also includes a set of lifting arms coupled to the cover. The set of lifting arms include one or more lifting arms. As used herein, the term "coupled" includes coupling via a separate object. For example, the set of lifting arms may be coupled to the cover if both the first leg and the second leg are coupled to a third object. The term "coupled" also includes "directly coupled," in which case the two objects touch each other in some way. The term "coupled" also encompasses two or more components that are continuous with one another by virtue of each of the components being formed from the same piece of material.

The apparatus includes a slowing device engaged with the set of lifting arms. As used herein, two components are "engaged" if they interact with each other in some way, such as through direct touching, a third object, or a magnetic force. For example, the slowing device is engaged with the set of lifting arms if they touch each other in some way or if they interact through a magnetic force.

The slowing device is adapted to slow movement of the set of lifting arms when the cover is moved from one position to another position in the plurality of positions. In one embodiment, the slowing device includes a channel that has at least one wall. In this embodiment, the channel guides the movement of the set of lifting arms.

In another embodiment, the set of lifting arms are slidably engaged with the at least one wall of the channel at a set of contact points. The set of contact points includes one or more contact points. As used here, a contact point is a point at which two objects touch one another. In one embodiment, friction at the set of contact points slows the movement of the set of lifting arms.

In another embodiment, the set of lifting arms includes a compressible member. In this embodiment, the compressible member and the at least one wall of the channel are slidably engaged at the set of contact points.

In another embodiment, the channel includes a stop member. In this embodiment, the stop member prevents the movement of the set of lifting arms beyond a designated point.

The apparatus also includes a stage coupled to the set of lifting arms such that movement of the cover causes movement of the stage into a position. The stage is adapted to receive the printable media. The position facilitates exposure of the printable media to, for example, a user. In one embodiment, the movement of the cover is in response to an act by a user, such as pushing a button on the printer.

Figure 4:
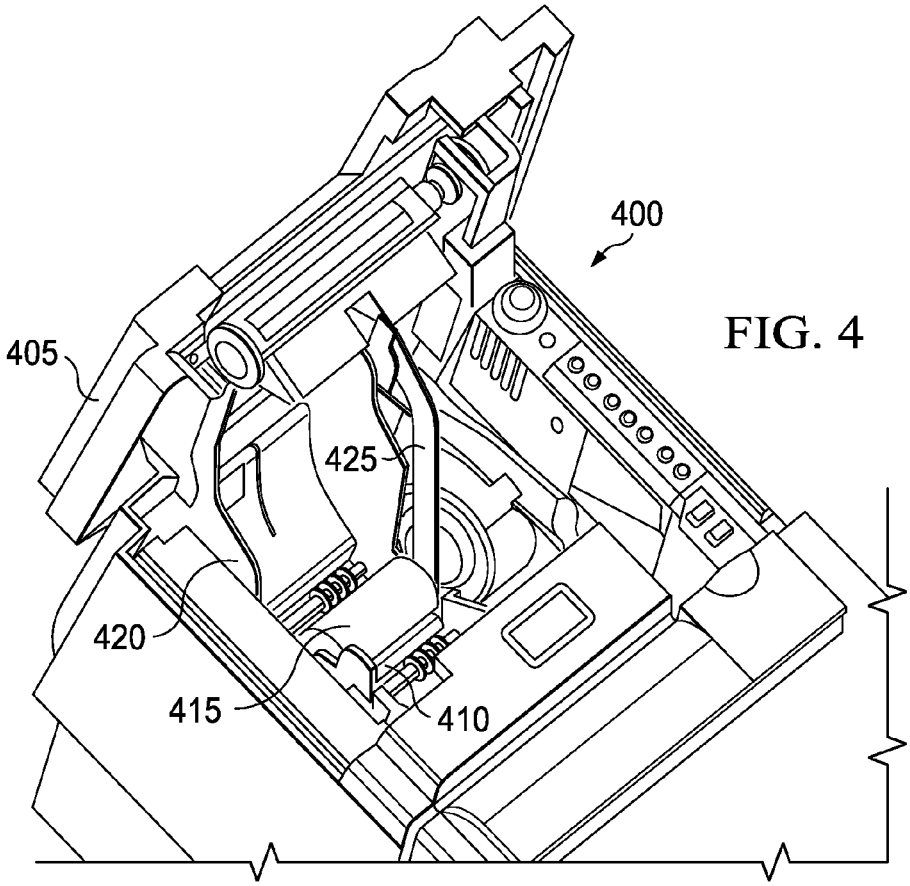
FIG. 4 is a perspective view of a printer used to expose printable media in accordance with an illustrative embodiment.

Turning now to FIG. 4, a perspective view of a printer used to expose printable media is depicted in accordance with an illustrative embodiment. Specifically, FIG. 4 shows printer 400 having cover 405 in an open position. Printer 400 is a non-limiting example of printer 115 in FIG. 1, printer 200 in FIG. 2, and printer 300 in FIG. 3. Because cover 405 is in an open position, some of the inner contents of printer 400 are revealed.

Stage 410 is coupled to cover 405 via lifting arms 420 and 425. Stage 410 is shown in a position such that printable media 415 is exposed. Printable media 415 rests on stage 410.

In FIG. 4, printable media 415 is illustrated as being nearly depleted in this example. Because printable media 415 is a roll of paper, the size of printable media 415 has decreased through use with less paper remaining on printable media 415. Because stage 410 is coupled to cover 405 via lifting arms 420 and 425, the opening of cover 405 has caused stage 410 to rise. The raised position of stage 410, on which printable media 415 rests, facilitates the exposure of printable media 415, and allows a user better access to printable media 415. Additional exemplary details regarding the components and operation of the apparatus in FIG. 4 are provided in the remaining figures.

Figure 5:
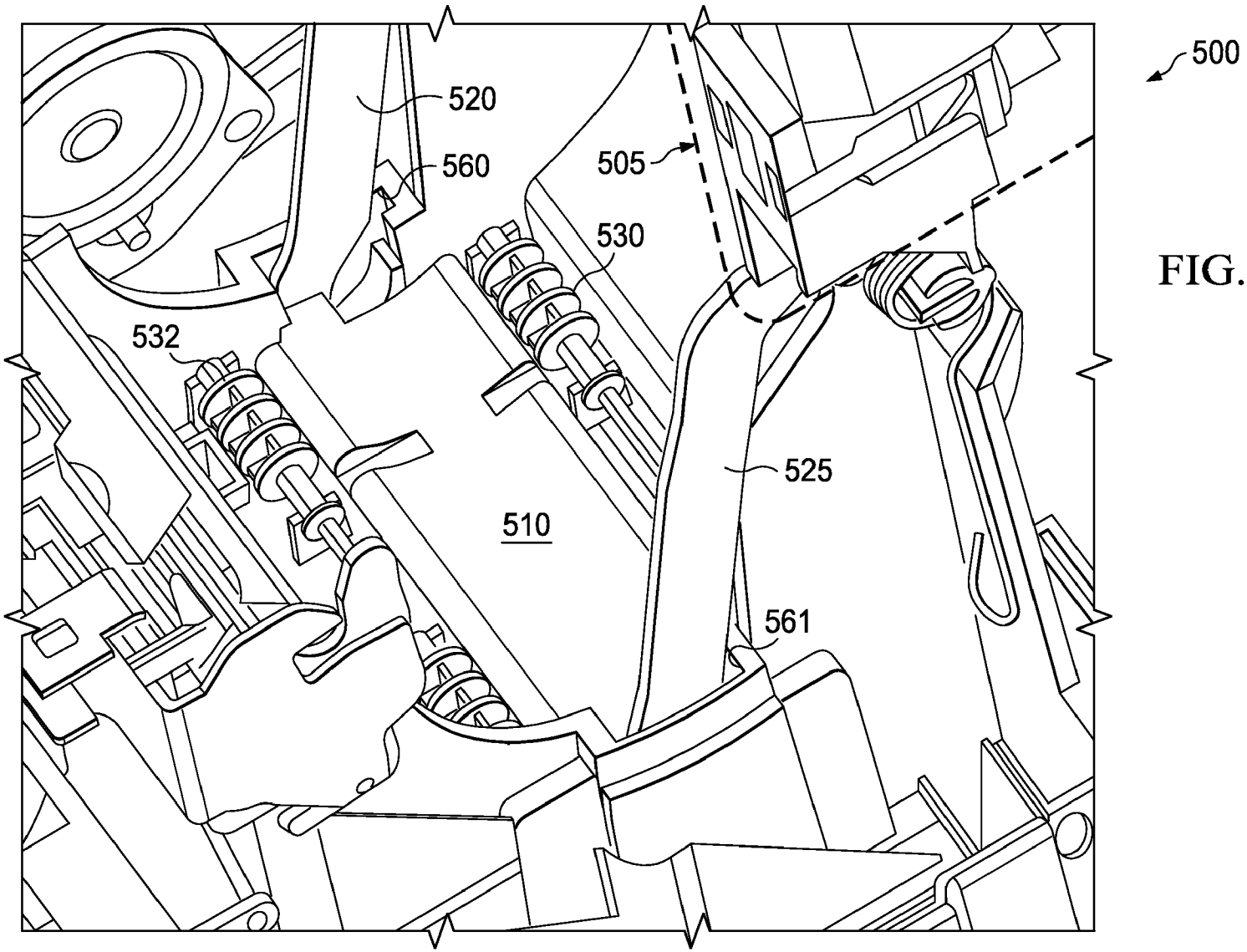
FIG. 5 is a perspective view of a printer used to expose printable media in accordance with an illustrative embodiment.

Turning now to FIG. 5, a perspective view of a printer used to expose printable media is depicted in accordance with an illustrative embodiment. Specifically, FIG. 5 shows printer 500, which is a non-limiting perspective view of printer 400 in FIG. 4.

Cover 505 of printer 500 is in an open position. Lifting arms 520 and 525 are coupled to cover 505. Lifting arms 520 and 525 are also coupled to stage 510, thereby coupling stage 510 and cover 505 with one another.

Lifting arms 520 and 525 may be coupled to stage 510 in a variety of ways. In one example, lifting arms 520 and 525 and stage 510 are formed from a single continuous piece of material. In this example, no space exists at the joint between lifting arms 520 and 525 and stage 510. In another example, lifting arms 520 and 525 may be screwed, glued, welded, bolted, or tied to stage 510.

Lifting arms 520 and 525 may be made from any material. For example, lifting arms 520 and 525 may be made of plastic, metal, rubber, wood, or any combination thereof. In addition, in addition to the shapes of lifting arms 520 and 525, lifting arms 520 and 525 may have any shape that permits coupling between cover 505 and stage 510. For example, lifting arms 520 and 525 may be a set of wires, or have an elliptical, polygonal, or circular cross section. The dimensions and placement of components inside printer 500 may also determine the proper shape, size, and material for lifting arms 520 and 525.

Stage 510 is adapted to receive printable media. An illustration of printable media received by a stage is illustrated by stage 410 and printable media 415 in FIG. 4. Stage 510 may be composed of any material, such as plastic, metal, rubber, wood, or any combination thereof. In one example, stage 510 is made of the same material as lifting arms 520 and 525 and form one continuous component.

Stage 510 may also have any shape that supports printable media. In one embodiment, the side of stage 510, upon which the printable media rests, has a concave surface. The concave surface may have different degrees of concavity depending on how securely the printable media needs to be supported. For example, higher degrees of concavity may be used to prevent the lateral movement of the printable media when stage 510 is in a raised position. In another example, stage 510 may include two or more bars or wires, which support the printable media. Other factors that may dictate the shape of stage 510 are the ability of the printable media to freely rotate when resting on stage 510, the dimensions and placement of components inside printer 500, and the need to prevent the printable media from lateral movement.

When stage 510 is in a lowered position, such as when cover 505 is closed, the printable media may rest upon rollers 530 and 532. Rollers 530 and 532 facilitate the rotation of the printable media. In one example, the printable media drops into a cavity just below rollers 530 and 532 when the diameter of the printable media becomes smaller than the distance between rollers 530 and 532. While in this cavity, the printable media is supported by stage 510. In one embodiment, the printable media's descent into the cavity may be detected by printer 500 and a low paper condition may be created. When stage 510 is in a raised position, the printable media, which triggered the low paper condition, may be supportably lifted out of the cavity defined by rollers 530 and 532.

The movement of cover 505 causes the movement of stage 510 into a raised position. In this raised position, the printable media may be supportably lifted out of the cavity defined by rollers 530 and 532. Hence, the printable media is exposed to a user and may be more easily accessed. In one embodiment, stage 510 is in this raised position when cover 505 is in an open position. Both FIG. 4 and FIG. 5 illustrate cover 405 and cover 505 in an open position, respectively.

The movement of cover 505 that causes the movement of stage 510 into a raised position may be in response to an act by a user. For example, cover 505 may be raised into an open position in response to a user pushing a button on user interface on printer 500, such as user interface controls 310 in FIG. 3. Cover 505 may also be raised into an open position in response to commands or instruction from an external data processing system, such as data processing system 100 in FIG. 1. In another example, the user may manually lift cover 505 into an open position.

In one embodiment, a user operates printer 500 to facilitate the exposure of printable media in printer 500. In this embodiment, the user moves cover 505. For example, the user may lift cover 505 into an open position using a button on printer 500. In response to a movement of cover 505, stage 510 is moved into a raised position. In response to moving stage 510 into a raised position, the printable media is lifted from between rollers 530 and 532 and exposed to the user.

FIG. 5 also illustrates slowing devices 560 and 561, which are engaged with lifting arms 520 and 525, respectively. The slowing of the movement of lifting arms 520 and 525 and stage 510 will be discussed in greater detail with respect to FIGS. 7 and 8.

Figure 6:
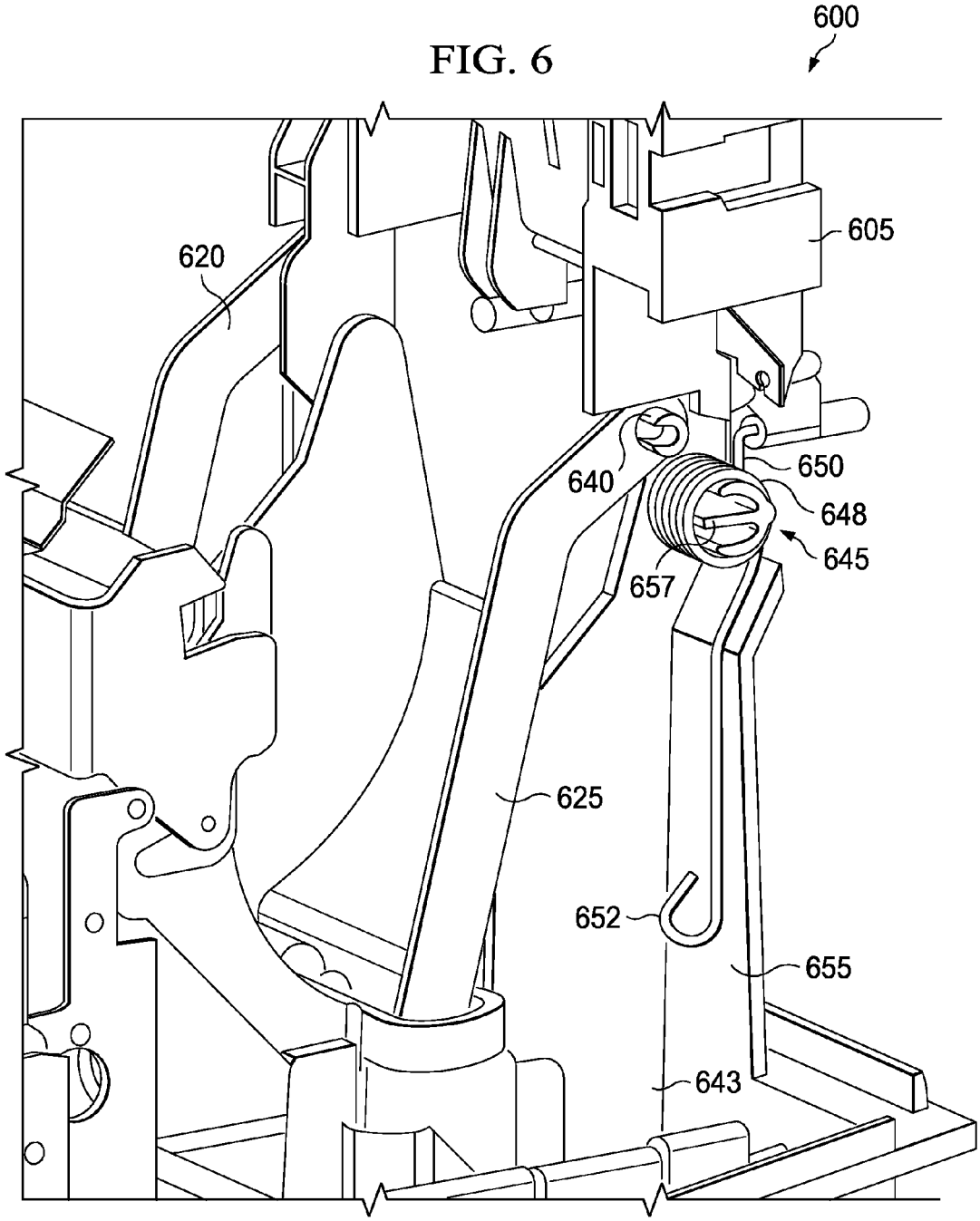
FIG. 6 is a perspective view of a printer used to expose printable media in accordance with an illustrative embodiment.

Turning now to FIG. 6, a perspective view of a printer used to expose printable media is depicted in accordance with an illustrative embodiment. Specifically, FIG. 6 shows printer 600, which is a non-limiting perspective view of printer 500 in FIG. 5. FIG. 6 also provides greater detail with respect to the couplings between lifting arms 620 and 625, cover 605, and printer 600. In FIG. 6, the outer portion of the cover of printer 600 is not shown.

Lifting arm 625 is pivotably coupled to cover 605 at pivot point 640. Lifting arm 620 is similarly coupled to cover 605, but at a different pivot point that is not shown in FIG. 6. Lifting arms 620 and 625 may be pivotably coupled to cover 605 in a variety of ways. For example, a screw, bolt, rod, or snap-in member may provide the axis or pivot around which lifting arm 625 pivots about pivot point 640. In another example in which lifting arms 620 and 625 are flexible, lifting arms 620 and 625 may wrap around a pivot point, such as a pulley, on cover 605. In this example, the pivot point may rotate as cover 605 is opened or closed. Although FIG. 6 shows lifting arms 620 and 625 as pivotably attached to cover 605, lifting arms 620 and 625 may also be fixedly attached to cover 605. For example, lifting arms 620 and 625 may be screwed, glued, welded, bolted, tied, or structurally continuous with cover 605.

Cover 605 is coupled to printer 600. Specifically, cover 605 is pivotably coupled to support wall 643 of printer 600 at pivot point 645. In one embodiment, a torsional force at pivot point 645 urges cover 605 into an open position. The torsional force may urge cover 605 into an open position by rotating cover 605 upward about the axis defined by pivot point 645.

In one embodiment, the torsional force that urges cover 605 into an open position is provided by torsional spring 648. Protruding portion 650 of torsional spring 648 is engaged with cover 605. Protruding portion 652 of torsional spring 648 is engaged with back support wall 655. Torsional spring 648 thus acts upon cover 605 and back support wall 655 to provide lift for cover 605.

Torsional spring 648 may be made of any material with properties that are suitable in a spring, such as metal, alloy, rubber, and some plastics. The cross-section of the wire or bar used in torsional spring 648 may be circular, elliptical, or polygonal. One factor in determining the amount of tension in torsional spring 648 is the need to provide enough lift to open cover 605.

Torsional spring 648 is wound around protruding member 657. Protruding member 657 protrudes from support wall 643. Protruding member 657 provides both an axis about which cover 605 may rotate and support for torsional spring 648.

As discussed above, the stage of printer 600, which is not shown in FIG. 6, is lifted into a raised position when cover 605 is opened. The distance through which the stage is raised may be varied by varying the distance between pivot points 640 and 645. For example, using a larger distance between pivot points 640 and 645 may increase the distance through which the stage is raised. By raising the stage through an increased distance, the printable media on the stage may be better exposed and more easily accessible.

Although FIG. 6 shows that cover 605 is opened using torsional spring 648, cover 605 may be opened using any lifting device. For example, cover 605 may be opened using hydraulic pistons that push cover 605 open. In another example, cover 605 may also be opened using springs that pull cover 605 open. In this example, the springs may be anchored to an outer portion of printer 600. Cover 605 may be opened using manual force from a user. In addition, cover 605 may be opened using software that controls a motorized mechanism. In one example, this software may be executed on a data processing system such as data processing system 100 in FIG. 1.

Figure 7:
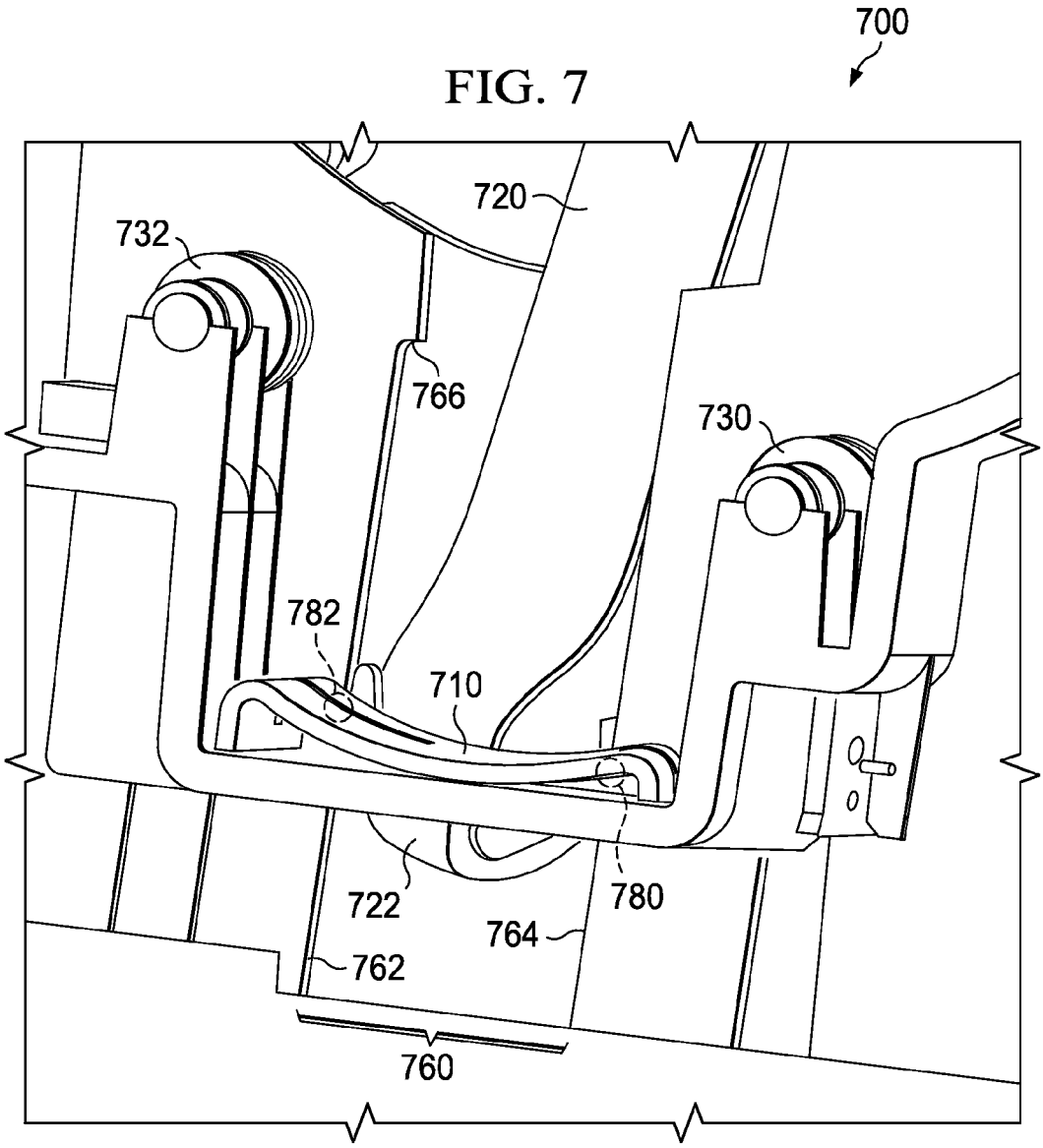
FIG. 7 is a perspective view of a printer used to expose printable media in accordance with an illustrative embodiment.

Turning now to FIG. 7, a perspective view of a printer used to expose printable media is depicted in accordance with an illustrative embodiment. Specifically, FIG. 7 shows printer 700, which is a non-limiting perspective view of printer 600 in FIG. 6. FIG. 7 also provides greater detail about the movement of stage 710 and lifting arm 720.

In FIG. 7, stage 710 is in a lowered position. Stage 710 may be in this lowered position when the cover of printer 700 is closed. When stage 710 is in a lowered position, printable media may rest against rollers 730 and 732. In one example, the printable media does not come into contact with stage 710. In another embodiment, stage 710 supports the printable media while stage 710 is in a lowered position by, for example, touching the printable media.

FIG. 7 also shows channel 760, which is an exemplary slowing device that is engaged with lifting arm 720. In one embodiment, the slowing device is channel 760. Channel 760 is adapted to slow the movement of lifting arm 720 when the cover of printer 700 is moved.

Channel 760 guides the movement of lifting arm 720. For example, channel 760 guides the movement of lifting arm 720 in an approximately vertical direction. However, channel 760 may guide the movement of lifting arm 720 in any direction that facilitates proper operation of the illustrative embodiments. In FIG. 7, channel 760 guides the movement of lifting arm 720 using channel walls 762 and 764.

The bottom end of lifting arm 720 includes compressible member 722. In one embodiment, compressible member 722 is a hook-shaped bendable part at the end of lifting arm 720 that pushes against channel walls 762 and 764. Although compressible member 722 has a hook-like shape in FIG. 7, compressible member 722 may have any shape that allows compressible member 722 to push against channel walls 762 and 764. For example, compressible member 722 may be a compressible rubber component, a compressible spring attached to lifting arm 720, a magnetic component that is attracted to channel walls 762 and 764, or any combination thereof.

Compressible member 722 is slidably engaged with channel walls 762 and 764 at contact points along channel walls 762 and 764. The contact points are points along channel walls 762 and 764 that touch compressible member 722 at any particular moment. In FIG. 7, compressible member 722 is slidably engaged with channel walls 762 and 764 at contact points 780 and 782.

Channel 760 also includes stop member 766. Stop member 766 will be discussed in greater detail with respect to FIG. 8 below.

Figure 8:
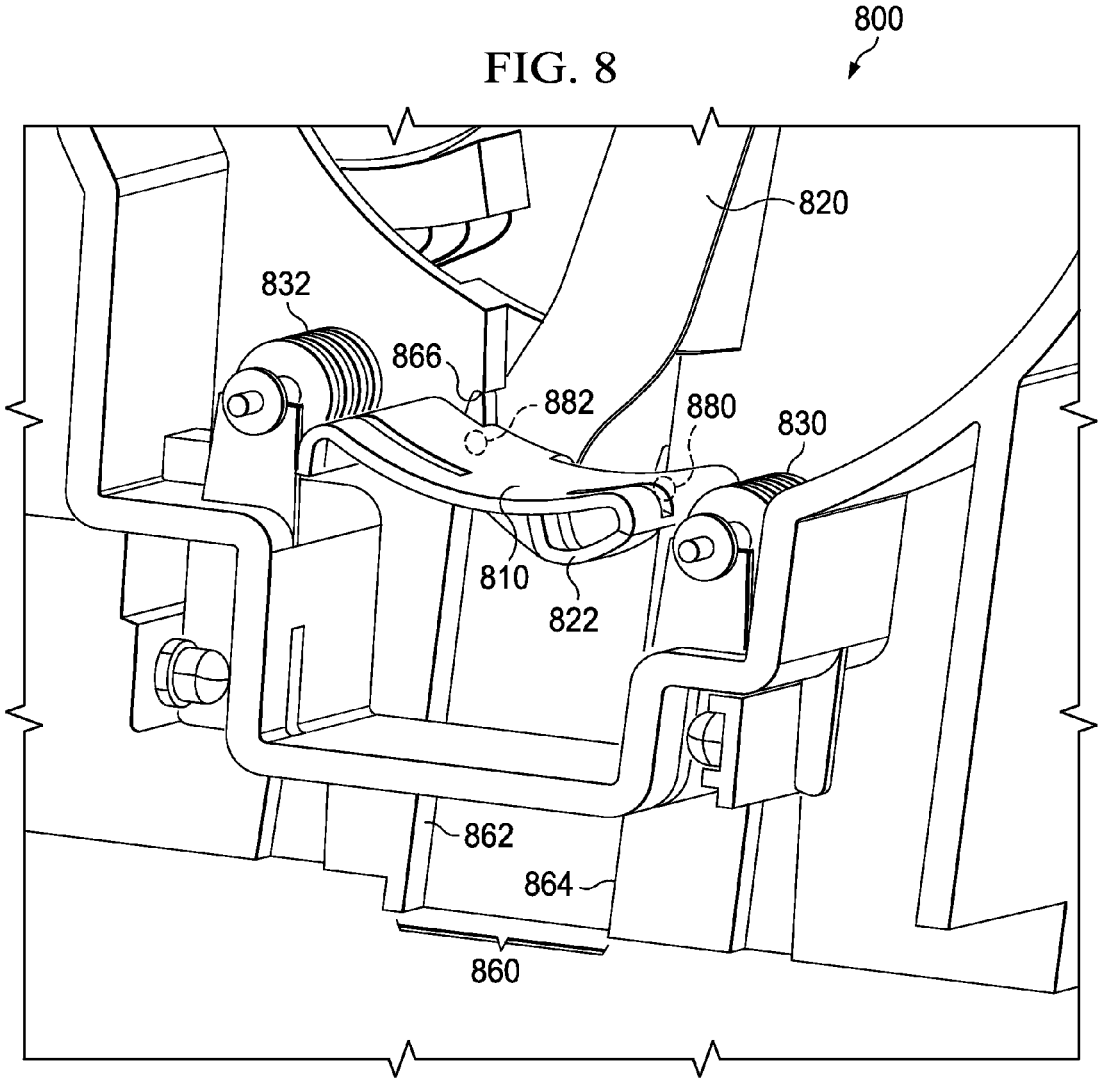
FIG. 8 is a perspective view of a printer used to expose printable media in accordance with an illustrative embodiment.

Turning now to FIG. 8, a perspective view of a printer used to expose printable media is depicted in accordance with an illustrative embodiment. Specifically, FIG. 8 shows printer 800, which is a non-limiting perspective view of printer 700 in FIG. 7. However, in FIG. 8, stage 810 is in a raised position due to the cover of printer 800 being in an open position. In this raised position, printable media that rests on stage 810 is lifted out of the space defined by rollers 830 and 832.

In moving from the lowered position of stage 710 in FIG. 7 to the raised position of stage 810, friction at contact points 880 and 882 slows the movement of lifting arm 820. Thus, the movement of stage 810 is also slowed. By slowing the movement of stage 810, the printable media that rests on stage 810 rises more slowly and is prevented from being launched upward. The opening of the cover of printer 800 is also less abrupt. Stage 810 may be lowered back into a lowered position, such as the lowered position of stage 710 in FIG. 7, by closing the cover of printer 800.

The friction at contact points 880 and 882 may be varied by adjusted the size and elasticity of the compressible member, as well as the distance between channel walls 862 and 864. A lubricant may also be added to compressible member or channel walls 862 and 864 to lessen the friction at contact points 880 and 882.

Although the slowing device is shown in FIG. 8 as channel 860, the slowing device may be any device that slows the movement of lifting arm 820. For example, the slowing device may be a spring or other elastic device that connects lifting arm 820 to a component below lifting arm 820. The slowing device may also be a hydraulic piston that resists the upward movement of lifting arm 820. The slowing device may also slow the movement of lifting arm 820 using magnetism. In this example, the bottom end of lifting arm 820 may be magnetically attracted to another component of printer 800, thereby slowing the movement of lifting arm 820.

Printer 800 also includes stop member 866. Stop member 866 is a notch along channel wall 862. Stop member 866 prevents the movement of lifting arm 820 past a designated point. In FIG. 8, the designated point is the location of the stopping member itself.

Although stop member 866 is shown as a notch along wall 862, stop member 866 may be any device that stops the movement of lifting arm 820 at a particular point. For example, the stop member may be rod or bar that blocks stage 810 from upward movement. The stop member may also be wire, string, or other connector that connects lifting arm 820 or stage 810 to another component of printer 800. The stop member may also be a device that blocks the upward movement of the cover of printer 800.

Figure 9:
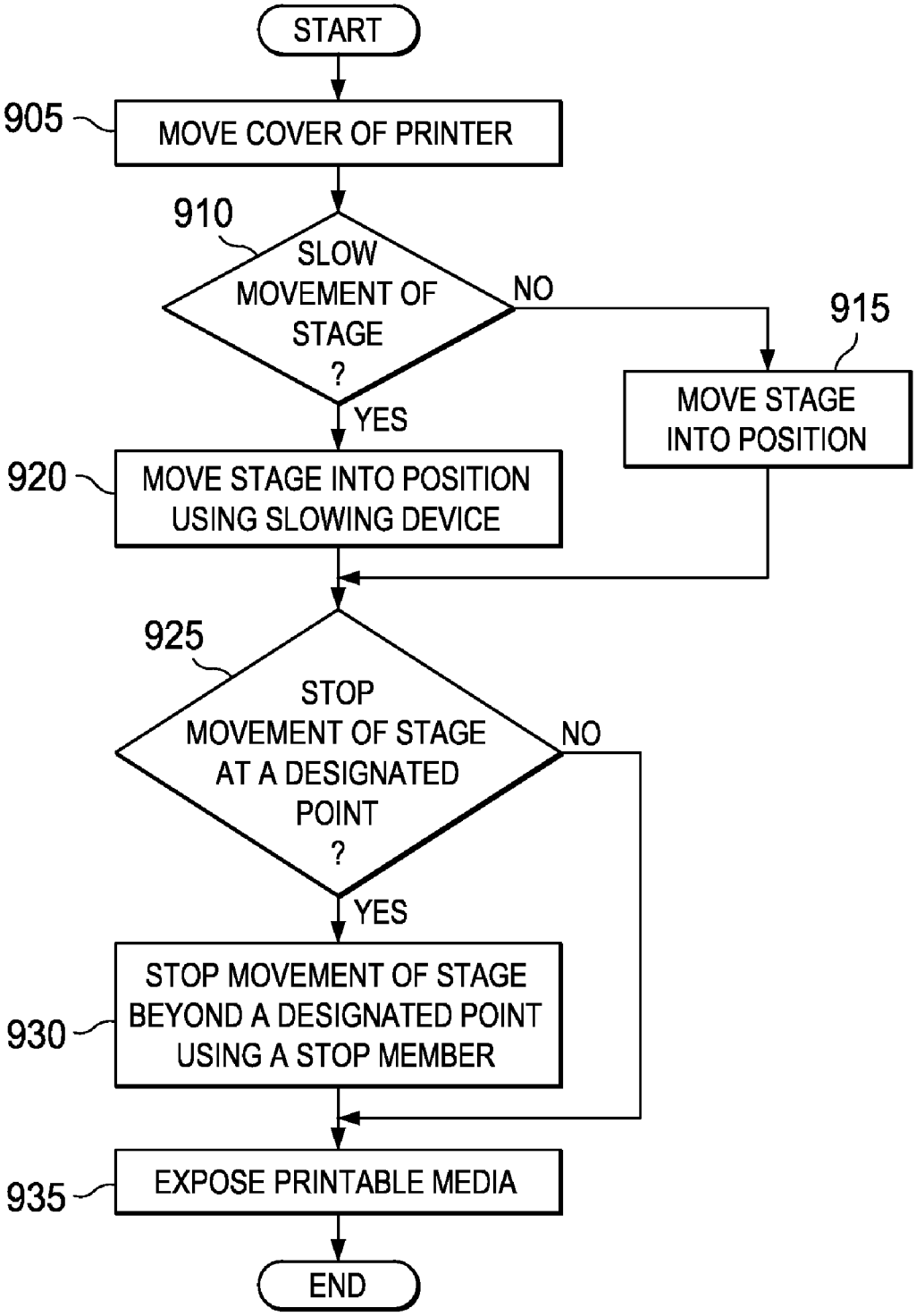
FIG. 9 is a flowchart illustrating a process to expose printable media in accordance with an illustrative embodiment.

Turning now to FIG. 9, a flowchart illustrating a process to expose printable media is depicted in accordance with an illustrative embodiment. The process illustrated in FIG. 9 may be implemented or initiated by a user or a program on a data processing system, such as data processing system 100 in FIG. 1.

The process begins by moving or lifting the cover of the printer (step 905). The process then determines whether the movement of the stage should be slowed (step 910). If the process determines that the movement of the stage should not be slowed, the process moves the stage into a raised position (step 915). The process then proceeds to step 925.

Returning to step 910, if the process determines that the movement of the stage should be slowed, the process moves the stage into the raised position using a slowing device (step 920). The process then determines whether to stop movement of the stage at a designated point (step 925). If the process determines not to stop movement of the stage at a designated point, the process proceeds to step 935.

Returning to step 925, if the process determines to stop movement of the stage at a designated point, the process prevents movement of the stage beyond a designated point using a stop member (step 930). The process then exposes the printable media supported by the stage (step 935). The process then terminates.

The flowcharts and block diagrams in the different depicted embodiments illustrate the architecture, functionality, and operation of some possible implementations of apparatus and methods. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

The illustrative embodiments described herein provide an apparatus and method for exposing printable media. In one embodiment, the printable media is a roll of paper. The apparatus includes a printer having a cover. The apparatus also includes a set of lifting arms coupled to the cover.

The apparatus includes a slowing device engaged with the set of lifting arms. The slowing device is adapted to slow movement of the set of lifting arms when the cover is moved. In one embodiment, the slowing device includes a channel that has at least one wall. In this embodiment, the channel guides the movement of the set of lifting arms.

In another embodiment, the set of lifting arms are slidably engaged with the at least one wall of the channel at a set of contact points. In one embodiment, friction at the set of contact points slows the movement of the set of lifting arms.

In another embodiment, the set of lifting arms includes a compressible member. In this embodiment, the compressible member and at least one wall of the channel are slidably engaged at the set of contact points.

In another embodiment, the channel includes a stop member. In this embodiment, the stop member prevents the movement of the set of lifting arms beyond a designated point.

The apparatus also includes a stage coupled to the set of lifting arms such that movement of the cover causes movement of the stage into a position. The stage is adapted to receive the printable media. The position facilitates exposure of the printable media to, for example, a user. In one embodiment, the movement of the cover is in response to an act by a user, such as pushing a button on the printer.

Thus, the illustrative embodiments introduce a mechanism that raises printable media to a more visible and reachable location as the printer cover is opened. Additionally, usability is enhanced with the introduction of springs that automatically open the cover when a mechanical or electronic button is pressed. However, a spring, such as a torsional spring, strong enough to assist cover opening with the full roll of paper mounted on the lift mechanism would open the cover too quickly with only the weight of a small core of the depleted roll of paper on the stage. To remedy this problem, a slowing device slows the lifting motion of the lifting arms and stage. Also, in the illustrative embodiment, a single component, composed of a set of lifting arms, stage, a slowing device, or any combination thereof, combines the functions of lifting the printable media for easy access, facilitate a drag or frictional force to soften the opening of the printer cover, and facilitate a stop limit on the upward motion of the printer cover.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus for exposing printable media, comprising:

a printer having a cover, wherein the cover is moveable to a plurality of positions;

a set of lifting arms coupled to the cover;

a slowing device engaged with the set of lifting arms, wherein the slowing device is adapted to slow movement of the set of lifting arms when the cover is moved from one position to another position in the plurality of positions; and a stage coupled to the set of lifting arms such that movement of the cover causes movement of the stage into a facilitating position, wherein the stage has a surface that supports the printable media and wherein the facilitating position facilitates exposure of the printable media.

2. The apparatus of claim 1, wherein the slowing device comprises:

a channel comprising a set of walls, wherein the channel guides the movement of the set of lifting arms.

3. The apparatus of claim 2, wherein the set of lifting arms are slidably engaged with the set of walls at a set of contact points.

4. The apparatus of claim 3, wherein the set of lifting arms further comprises: a compressible member, and wherein the compressible member and the set of walls are slidably engaged at the set of contact points.

5. The apparatus of claim 4, wherein friction at the set of contact points slows the movement of the set of lifting arms.

6. The apparatus of claim 2, wherein the channel further comprises:

a stop member, wherein the stop member prevents the movement of the set of lifting arms beyond a designated point.

7. The apparatus of claim 1, wherein the set of lifting arms are pivotably coupled to the cover at a first pivot point.

8. The apparatus of claim 7, wherein the cover is pivotably coupled to the printer at a second pivot point, and wherein a torsional force at the second pivot point urges the cover to an open position.

9. The apparatus of claim 8, further comprising:

a torsional spring, wherein the torsional spring causes the torsional force.

10. The apparatus of claim 9, wherein the facilitating position is based on a distance between the first pivot point and the second pivot point.

11. The apparatus of claim 1, wherein the stage is in the facilitating position when the cover is in an open position.

12. The apparatus of claim 1, wherein the movement of the cover is in response to an act by a user.

13. The apparatus of claim 1, wherein the printable media is a roll of paper.

14. The apparatus of claim 1, wherein the stage comprises a concave surface.

15. A method for exposing printable media in a printer, comprising:

responsive to moving a cover coupled to a stage, moving the stage into a facilitating position, wherein the facilitating position facilitates exposure of the printable media, wherein the cover is coupled to the stage via a set of lifting arms, wherein the stage has a surface that supports the printable media, and wherein the cover is moveable to a plurality of positions;

slowing movement of the set of lifting arms using a slowing device when the cover is moved from one position to another position in the plurality of positions, wherein the slowing device is engaged with the set of lifting arms.

16. The method of claim 15, wherein the slowing device comprises a channel, wherein the channel comprises a set of walls, further comprising:

guiding the movement of the set of lifting arms using the channel.

17. The method of claim 16, wherein the set of lifting arms comprises a compressible member, and wherein the compressible member and the set of walls are slidably abutting.

18. The method of claim 16, wherein the channel comprises a stop member, further comprising:

preventing the movement of the set of lifting arms beyond a designated point using the stop member.

19. The method of claim 15, wherein the cover is pivotably coupled to the printer at a pivot point, and wherein a torsional force at the pivot point urges the cover to an open position.

20. An apparatus for exposing a roll of paper, comprising:

a printer pivotably coupled to a cover at a pivot point, wherein the cover is moveable to a plurality of positions, wherein a torsional force at the pivot point urges the cover to an open position in the plurality of positions;

a set of lifting arms pivotably coupled to the cover, wherein the set of lifting arms comprises a compressible member;

a channel comprising a set of walls slidably engaged with the compressible member, wherein the channel slows movement of the set of lifting arms when the cover is moved from one position to another position in the plurality of positions;

a stop member, wherein the stop member prevents the movement of the set of lifting arms beyond a designated point; and a stage coupled to the set of lifting arms such that movement of the cover causes movement of the stage into the open position, wherein the stage has a surface that supports the roll of paper, and wherein the open position facilitates exposure of the roll of paper.

* * * * *